US007150663B2

(12) United States Patent
Saito

(10) Patent No.: US 7,150,663 B2
(45) Date of Patent: Dec. 19, 2006

(54) PIVOTING ARRANGEMENT FOR CONTROLLING OUTBOARD DRIVE OF PROPULSION UNIT

(75) Inventor: Hideaki Saito, Kakegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 100 days.

(21) Appl. No.: 10/711,338

(22) Filed: Sep. 12, 2004

(65) Prior Publication Data

US 2005/0090164 A1 Apr. 28, 2005

(30) Foreign Application Priority Data

Oct. 22, 2003 (JP) ..... 2003-362543

(51) Int. Cl.
*B63H 5/125* (2006.01)

(52) U.S. Cl. ..... 440/53; 440/81 T

(58) Field of Classification Search ..... 440/53, 440/61 R, 61 T; 91/422
See application file for complete search history.

(56) References Cited

U.S. PATENT DOCUMENTS 4,119,054 A * 10/1978 Pichl ..... 440/61 R
4,406,634 A * 9/1983 Blanchard ..... 440/61 R
6,039,617 A * 3/2000 Nakamura ..... 440/61 R
6,165,032 A * 12/2000 Nakamura ..... 440/61 R

FOREIGN PATENT DOCUMENTS

JP 07-69289 3/1995

* cited by examiner

*Primary Examiner*—Lars A. Olson
(74) *Attorney, Agent, or Firm*—Ernest A Beutler

(57) ABSTRACT

A pivoting arrangement for connecting an actuator to the outboard drive portion of a marine propulsion unit and more particularly to an arrangement for strengthening the pivotal connection without significantly increasing its size and by simplifying its construction to reduce cost.

5 Claims, 5 Drawing Sheets

PIVOTING ARRANGEMENT FOR CONTROLLING OUTBOARD DRIVE OF PROPULSION UNIT

BACKGROUND OF INVENTION

This invention relates to a pivoting arrangement for connecting an actuator to the outboard drive portion of a marine propulsion unit and more particularly to an arrangement for strengthening the pivotal connection without significantly increasing its size and by simplifying its construction to reduce cost.

As is well known, many marine propulsion systems, particularly ones having larger displacements employ hydraulically operated trim and tilt controls. These systems generally permit trim adjustment when the watercraft is in motion and tilting up out of the water for trailering or service. In addition they generally incorporate a pop up damping arrangement that permits the propulsion unit to pop up when an underwater obstacle is encountered to prevent damage and return to the trim adjusted position when it is cleared.

One such arrangement is shown in Published Japanese Application, publication number Hei 07-69289, published Mar. 14, 1995. As shown in that publication, the tilt and trim arrangement comprises a clamp bracket fixed to the watercrafthull and on which a propulsion unit is pivotally supported for the trim and tilt operation. This is accomplished by a tilt cylinder mounted with its axis extending in a generally vertical direction and capable of expanding and retracting in the axial direction. The lower end of the cylinder is pivotally supported by the clamp bracket through a lower pivot and its upper end is pivotally connected to the propulsion unit through an upper pivot. A pressurized oil control system for controlling oil delivery to accomplish the desired motion.

As seen in that publication both the upper and lower pivotal connections require at least one pin receiving that receives a respective, separate pin that must be somehow connected to the propulsion unit and the clamping bracket that forms the attachment to the hull of the associated watercraft. This increases the number of parts and the assembly operation and obviously the cost. Also the use of separate pins can decrease or prevent the increase of the strength of the unit. Although strength can be increased by increasing the size, the construction does not offer excess space for such a resolution to the problem.

In addition and particularly with the lower connection to the propulsion unit, a pair of side members are affixed to the lower end of the cylinder housing and these each to receive a respective pivot pin for attachment to the watercraft hull, generally through a clamping bracket. This requires alignment and accurate location of these several parts. Also since the pivot is provided by pins in addition to the attachment plates and clamping brackets, the number of parts is increased and its construction and assembly is complicated.

Therefore it is a principal object of the invention to provide a pivoting arrangement for connecting an actuator to the outboard drive portion of a marine propulsion unit and more particularly to an arrangement for strengthening the pivotal connection without significantly increasing its size and by simplifying its construction to reduce cost.

SUMMARY OF INVENTION

A pivoting arrangement for effecting pivotal movement of a marine propulsion device adapted to be pivotally supported about a pivot axis on an associated watercraft. The pivoting arrangement comprises a cylinder assembly defining a cylinder bore and adapted to be pivotally connected to one of the watercraft and the marine propulsion device. A piston is supported for reciprocation within the cylinder bore and a piston rod is fixed to the piston for operation thereby. The piston rod extends externally of the cylinder assembly and adapted to be pivotally connected to the other of the watercraft and the marine propulsion device. In accordance with the invention, at least one of the pivotal connections are formed by a cylindrical portions integrally formed by the associated component being pivotally connected.

DETAILED DESCRIPTION

Figure 1:
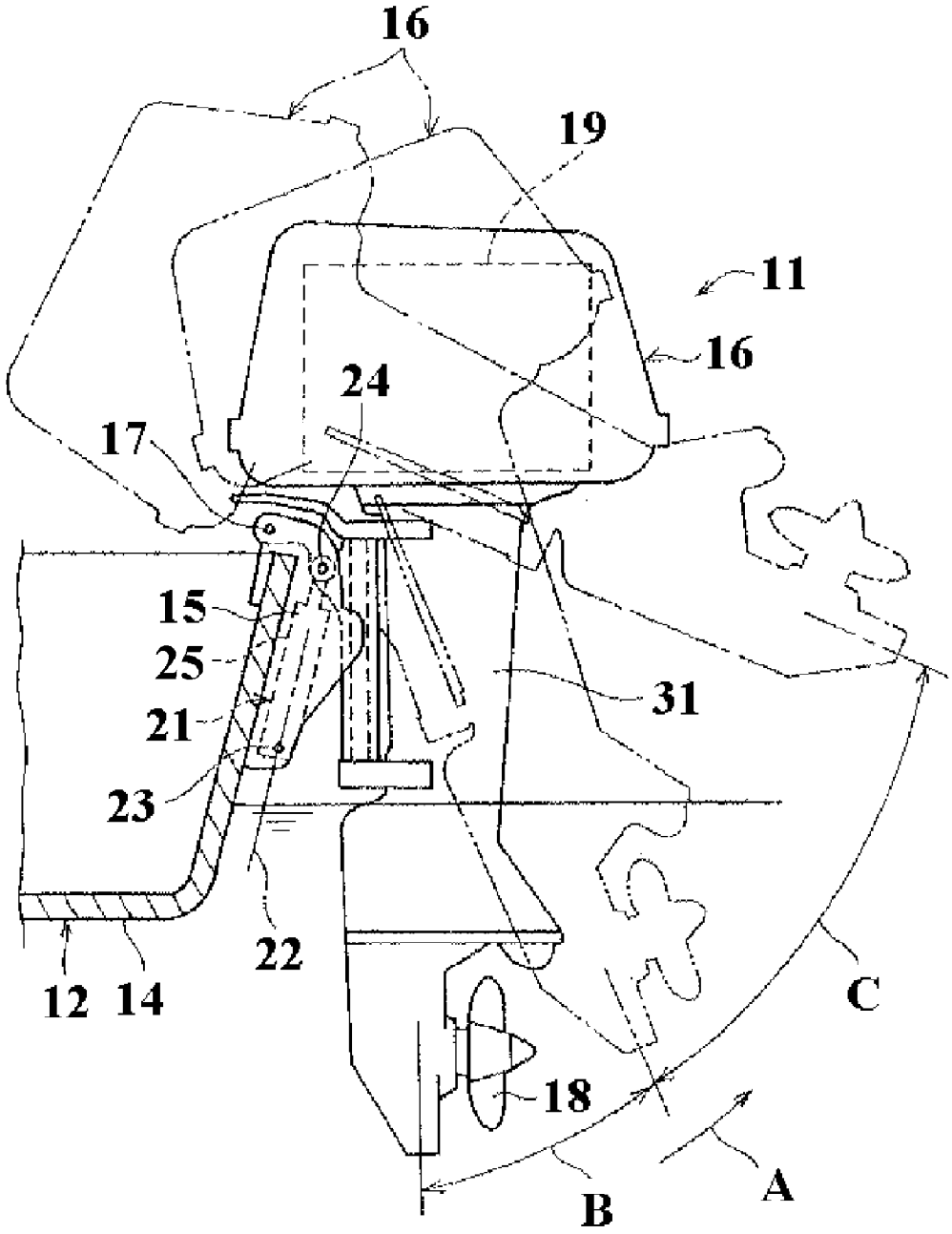
FIG. 1 is a side elevational view of a portion of a watercraft (shown partially and in cross section) with a propulsion unit attached utilizing a tilt and trim unit constructed in accordance with the invention, showing the range of trim and tilt movements in phantom lines.

Referring now in detail to the drawings and initially to FIG. 1, a watercraft propulsion unit in the form of an outboard motor 11 for propelling a watercraft such as a boat, indicated generally at 12, is supported on a transom 13 formed at a rear of a hull 14 of the boat 12. The outboard motor 11 includes, as part of its tilt and trim apparatus, a clamp bracket 15 removably mounted to the rear of the transom 13 of the hull 14 by means of fasteners (not shown).

As is well known in the art, the outboard motor 11 includes a propulsion unit, indicated generally at l6 provided at a rear of the clamp bracket 15 and pivotally supported by an upper part of the clamp bracket 15 by means of a pivot pin 17 to allow a propulsion device such as a propeller 18 at the lower part of the propulsion unit 16 to pivot in a manner to be described. The propeller 18 is driven in any desired manner such as by an internal combustion engine.

The upward pivotal movement from the fully tilted and trimmed down position shown in solid lines in FIG. 1 is rearward and upward in the direction of the arrow A in this figure through a trim range B and a fully tilted up range C. This movement is effected and controlled by a hydraulic tilt and trim cylinder indicated generally by the reference numeral 21. The tilt and trim cylinder is mounted with its axis 22, to be described in more detail later by reference to the remaining figures, extending in a generally vertical direction with its lower end pivotally supported by a lower part of the clamp bracket 15 by means of a lower pivot 23, as is well known in the art and in a specific manner to be described in more detail later.

A piston rod (to be identified in more detail later) of the tilt and trim cylinder assembly 21 has its upper end pivotally connected to the propulsion unit 16 by means of an upper pivot 24, in a manner as will also be described in more detail later. As will be described later, a pressurized oil control system controls delivery to/or exhaust from the chambers, to be described, of the tilt and trim cylinder 21 to operate the tilt and trim cylinder 21.

Figure 2:
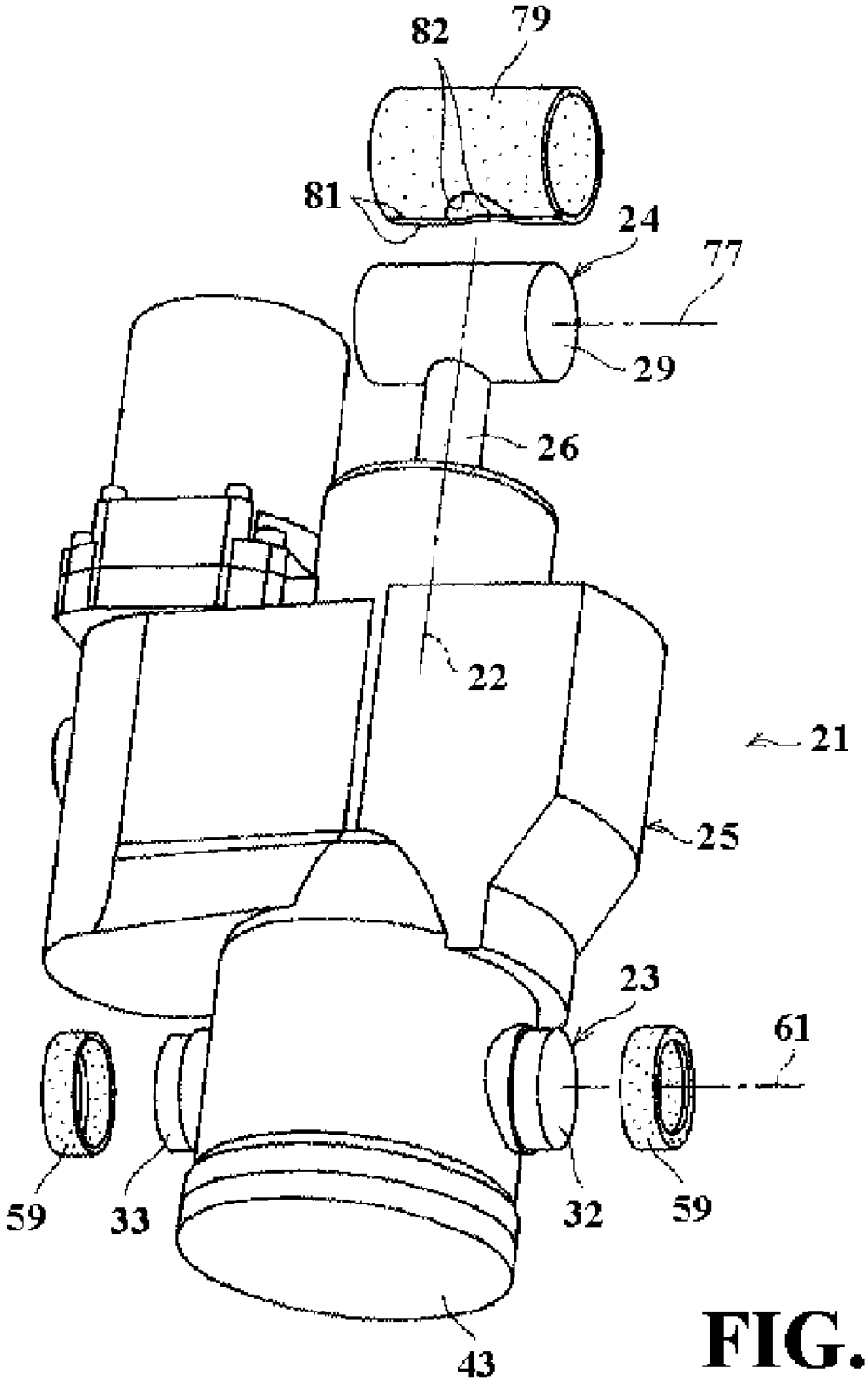
FIG. 2 is a perspective view of the trim and tilt unit.

Referring now to FIG. 2, this shows in perspective, the tilt and trim cylinder 21 that includes a cylinder body, indicated generally by the reference numeral 25, and from which the aforenoted piston rod 26 extends in a generally upward direction. Mounted to one side of the cylinder body 25 are some components of a hydraulic control system including a reversible electric motor (not shown) container in a housing 28 that contains a reversible electric motor, for a purpose to be described.

As seen in this figure the upper pivot 24 comprises a cylindrical element 29 connected, in a manner to be described later primarily by reference to FIGS. 4 and 5, to a drive shaft housing 31 of the outboard motor 11 (see FIG. 1). Also seen in this figure are a pair of integral projections 32 and 33 formed on opposite sides of the cylinder body 25 which function in a manner to be described by particular reference to FIGS. 3 and 4 to provide the lower pivot 23.

Figure 3:
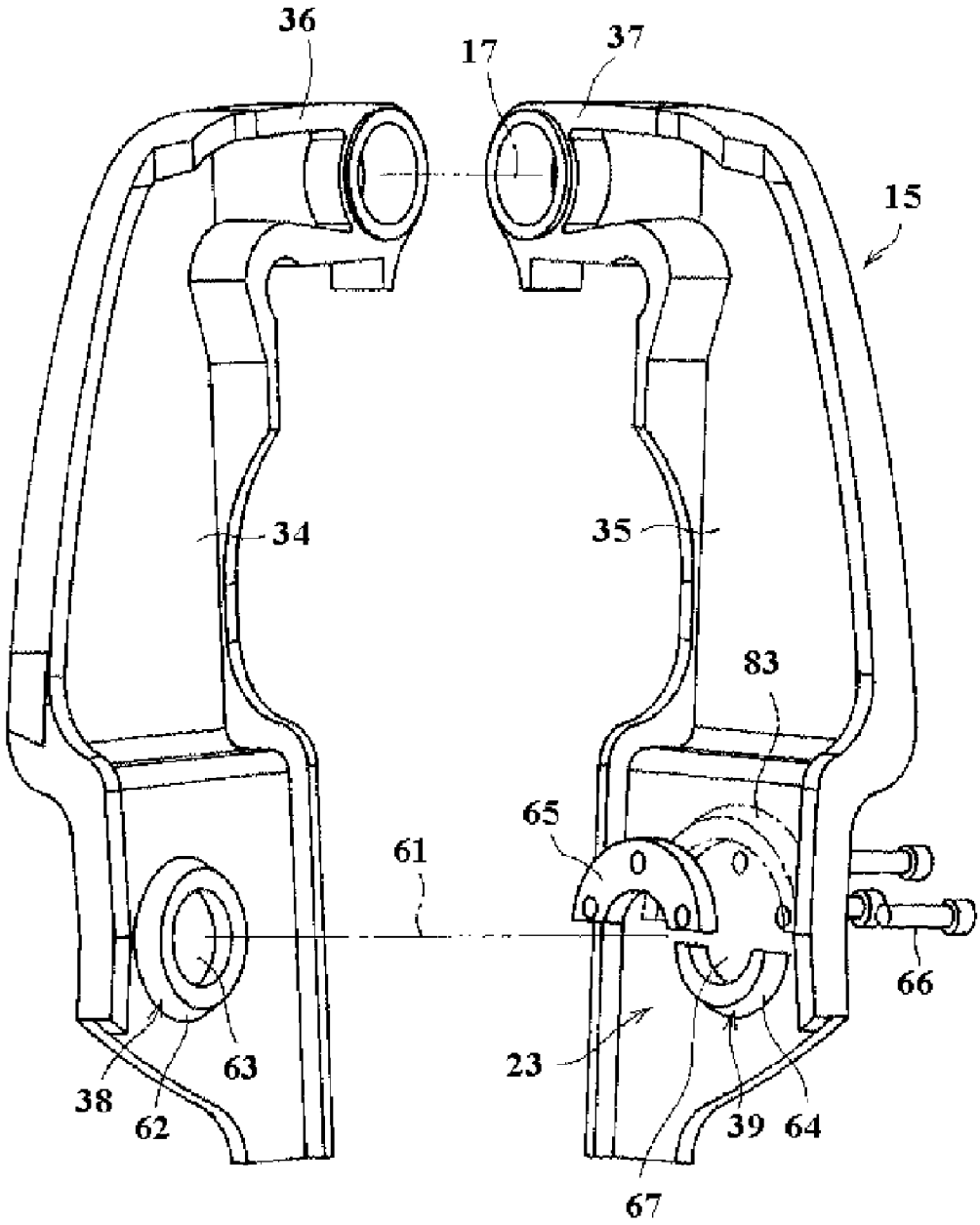
FIG. 3 is an exploded perspective view of the clamping bracket.

Referring now to FIG. 3 it will be seen that the clamp bracket 15 is comprised of cooperating left and right side members 34 and 35 that have respective bosses 36 and 37 that receive the pivot pin 17 for the pivotal support of the propulsion unit 16 for its tilt and trim movement. The lower portions of the side members 34 and 35 have bearing members 38 and 39 for pivotally receiving the projections 32 and 33 of the cylinder body 25 in a manner to be described.

The hydraulic system for achieving the tilt and trim movement will now be described by reference to FIG. 4. As has already been noted, the tilt and trim cylinder 21 includes a cylinder body 25 that forms its outer shell and which is pivotally supported by the lower part of the clamp bracket 15 by means of the lower pivot 23. The lower portion of the cylinder body 25 has a larger diameter cylinder bore 41 formed around the axis 22, into which a large diameter piston 42 is fitted for reciprocation in the axial direction. The piston 42 divides the large cylinder bore 41 into an upper chamber 43 and a lower chamber 44. The lower end of the large cylinder bore 41 and lower chamber 44 are closed by a closure plug 45 by means of a threaded connection 46 at the lower end of the large cylinder bore 41.

A smaller diameter cylinder bore 47 is formed around the axis 22 in a part of the cylinder body 25 above the large cylinder bore 41 with its lower end communicating with an upper end of the large cylinder bore 41. A cylinder tube 48 is reciprocally fitted into the small cylinder bore 47 for movement in the axial direction and is fixed to the large piston 42. A small piston assembly, indicated generally at 49, is supported for reciprocation in a smaller cylinder bore 51 formed in the cylinder tube 48. The small piston assembly 49 divides the smaller cylinder bore 51 into upper and lower bore portions 52 and 53, respectively.

The piston rod 26 is fixed to and extends upward from the small piston assembly 49 through an end wall if the cylinder housing 25 along the axis 22. The upper, exposed end of the piston rod 26, as has been noted, provides the pivotal connection to the propulsion unit 16 through the upper pivot 24.

A stopper ring 54 is fixed in the smaller cylinder bore 51 of the cylinder tube 48 to limit the downward movement of the small piston assembly 49 In a like manner, an upper stopper ring 55 is provided to prevent the small piston 49 from moving up further than an upper predetermined position in the smaller cylinder bore 51.

The small piston 49 is comprised of upper and lower piston portions 56 and 57 that are each individually reciprocal in the smaller cylinder bore 51. The upper piston portion 56 divides the upper bore portion 49 of the smaller cylinder bore 51 into upper and lower areas. The piston rod 26 extends upward from the upper piston portion 54 through both the bore areas. The stopper ring 53 prevents the upper piston portion 54 of the small piston assembly 49 from moving up further than the predetermined position in the smaller cylinder bore 51.

The hydraulic system for controlling the trim and tilt operation is described in more detail my co-pending application entitled "TRIM SYSTEM FOR MARINE PROPULSION", Ser. No. 10/711,335, filed concurrently with this application, this hydraulic system operates to permit trim up from the fully trimmed down position shown here in FIG. 4, to a fully trimmed up position at a low speed but with a high force due to the large diameter of the piston 42 and then, if desired, to a fully tilted up position at a greater speed due to the smaller diameter of the piston assembly 49. This difference in force and speed is desired because the trim operation is normally done when operating the associated watercraft in a forward direction but the tilt up operation is done when in a stationary position.

As is also noted in the aforenoted co-pending application, the system operates to permit popping up from any set trim position is permitted when an underwater obstacle is encountered, how the popping up action is damped to a stop and the propulsion unit 16 can return to the trim adjusted position when the obstacle is cleared. This popping up and associated damping at the end of travel works from any trim adjusted position, as is also described in that co-pending application and for that reason further discussion thereof is not believed necessary for those skilled in the art to understand the invention hereof.

In order to prevent direct metal to metal contact upon extreme pop up action and to cushion the stopping of such movement and as described in more detail in my related, co-pending application, entitled "TILT AND TRIM SYSTEM OF OUTBOARD DRIVE OF PROPULSION UNIT", Ser. No. 10/711,337, filed concurrently herewith, an oil lock piston 58 is fitted into the upper bore area of the upper bore portion 52 and normally disposed at a gap above the upper piston portion 54. A small annular gap is formed between the inner peripheral surface of the upper bore portion 52 and the outer peripheral surface of the oil lock piston 58 for permitting oil to flow past the oil lock piston 58.

If the oil lock piston 58 is tending to move up further than the upper predetermined position in the upper end in the upper bore portion 52 of the smaller cylinder bore 51, the oil lock piston 58 abuts directly with the stopper ring 55 and thus is prevented from moving up further. Since the oil lock piston 58 is thus prevented from moving up, the upper piston portion 56 is also prevented from moving up further.

Since the hydraulic system for permitting and controlling these operations is not an important feature of the invention in this case and any desired system can be utilized the disclosure of the aforenoted co-pending applications is incorporated herein by reference and further description of it is not believed necessary to permit those skilled in the art to practice the invention hereof.

The constructions of the pivotal connections 23 and 24 will now be described initially to the lower connection 23, by principal reference to FIGS. 2–4. As has been noted, the lower pivot 23 comprises left and right projections 32 and 33 formed integrally with and projecting outward from the left and right sides of the cylinder body 25. To provide an anti-frictional connection, complimentary plastic bushings 59 are fitted over these projections 32 and 33. These are received in the aforenoted paired left and right bearing members 38 and 39 formed by the bracket members 34 and 35 of the clamp bracket 15 for pivoting the respective projections 32 and 33 about a lower axis, indicated at 61.

The bearing member 38 on one side has a boss 62 provided as projecting integrally with the bracket member 34 on one side facing the other bracket member 35. The boss 62 is provided with a bearing bore 63 centered on the lower axis 61. The projection 32 on one side is inserted together with its bushing 59 into the bearing bore 63 on the lower axis 61 and pivotally supported on the boss 62.

The bearing member 39 of the other side comprises a semicircular bearing member 64 for receiving the projection 33 on its underside through the lower portion of the bushing 59. A semicircular holding member 65 for holding retaining the projection 33 in pivotal relation with the bearing member 64 and engaging the upper portion of the bushing 59. Threaded fasteners 66 removably securing the holding member 65 to the bracket member 35 from the other side, so that the space between the bearing member 64 and the holding member 65 forms a bearing bore 67 into which the projection 33 is received and pivoted.

Now the construction of the upper pivot member 24 will be described by reference to FIGS. 4 and 5. As has been noted, this comprises a solid cylindrical element 29 placed at the upper end of the axis 22 with its axially middle portion secured by a threaded connection 68 to an extended end portion of the piston rod 33. The outer ends of the cylindrical element 29 cooperate with paired left and right cylindrical bearing bores 69 and 69 of a circular cross section formed in a manner to be described on the upper portion of the propulsion unit 16 on opposite sides of the cylinder axis 22. The respective end portions of the element 29 are journalled in a manner to be described in respective of these bearing bores 69 to provide the pivotal connection to the propulsion unit 16. Although a threaded connection is illustrated between the piston rod 26 and the cylindrical element 29 other means of attachment may be employed such as welding. Besides, both ends of the cylindrical element 29 may be of a truncated conical shape with its diameter dimension slightly tapering toward its ends.

Figure 5:
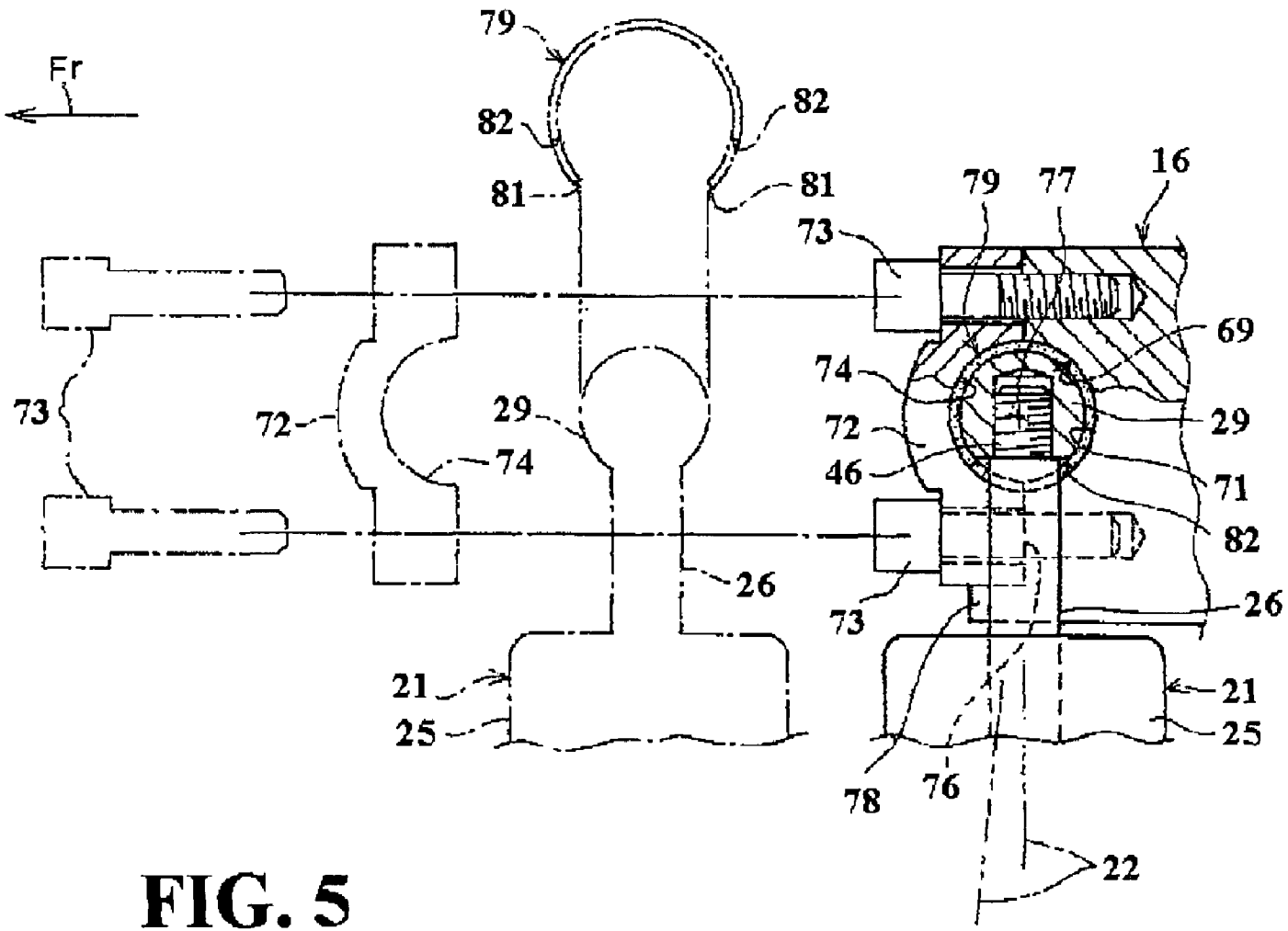
FIG. 5 is a cross sectional, taken along the line 5—5 in FIG. 4, showing the pivotal connection between the piston rod and the outboard drive with the connecting parts being shown in phantom in an exploded portion of the figure.

As best seen in FIG. 5, a semicircular arcuate recesses 71 that is forwardly open is formed in the upper portion of the propulsion unit 16. Paired left and right securing members 72 are provided, facing the arcuate recess 71 from the front and secured respectively by means of threaded fasteners 73 to the upper portion of the propulsion unit 16. Each of these securing members 72 is formed with a semicircular arcuate recess 74 facing the recess 71. Thus bearing bores are formed between the upper portion of the propulsion unit 16 and the mutually opposite surfaces of the securing members by means of both the arcuate recesses 71 and 74.

In a "normal attitude" of the propulsion unit 16, mutually matching surfaces 76 of the upper portion of the propulsion unit 16 and the securing members 72 are made approximately parallel to the axis 22 of the tilt cylinder 21. Extensions of the planes of the matching surfaces 76 pass the vicinity of an upper axis, indicated at 77 of the cylindrical element 29 of the upper pivot 24. To be more specific, in the above-described "normal attitude" of the propulsion unit 16, while the matching surface 76 and the axis 22 of the tilt cylinder 21 in side view of the outboard motor 11 are approximately parallel to each other, the matching surface 76 extends approximately in a vertical direction and the axis 22 is slightly tilted to the matching surface 76 as indicated with a phantom line in FIG. 5.

A pair of left and right support members 78 are formed integrally with the propulsion unit 16 projecting forward from the front face of the propulsion unit 16 support the respective securing members 72. Therefore, the securing of the securing members 72 to the upper portion of the propulsion unit 16 is reinforced by the support members 78. In other words, pivoting strength of the upper end portion of the tilt cylinder 21 onto the upper portion of the propulsion unit 16 is improved. In addition when the securing members 72 are secured by means of the threaded fasteners 73 to the upper portion of the propulsion unit 16, it is possible to temporarily place the securing members 72 on the top surface of the support members 78. Therefore, the work of securing the securing members 72 to the upper portion of the propulsion unit 16 is facilitated.

For anti-friction operation, a plastic, hollow anti-friction cylindrical bushing, indicated generally at 79, is fit over the cylindrical element 55 of the upper pivot 24. Both ends of the cylindrical element 55 are pivoted through the bushing 79 on the inside cylindrical surfaces of the respective bearing bores 74. The bushing 79 is split in the circumferential direction to form separated ends 81 that can be separated from each other by elastic deformation of the bushing 79. Thus the bushing 79 can be fit to or removed from the cylindrical element 55 in its radial direction because of the separated ends 81. In this case, cuts 82 are formed between both the separated ends 81 to clear the piston rod 33 when the ends 81 are released.

The assembly and disassembly of the lower pivot 23 will now be described by reference to FIG. 4. As may be seen in this figure, when the threaded fasteners 66 are loosened and the semicircular holding member 65 can be removed from the bracket member 35, the top side of the bearing member 39 is opened. Thus when the tilt cylinder 21 is wholly moved toward the bracket member 35 in the direction shown by the arrow B in FIG. 4, the opposite projection 32 can be removed from the boss 38 and the lower end of the cylinder 21 is freed. Then the cylinder 21 can be moved axially upwardly in the direction of the arrow C as shown in FIG. 4.

Assembly is done in the opposite manner. That is, the removed tilt cylinder 21 is moved in the direction opposite to the above (opposite to the arrows C and B in that order) and the semicircular holding member 65 is attached by means of the threaded fasteners 66 to the bracket member 35 and both the projections 32 and 33 are pivoted again in the respective bearing members 38 and 39.

Figure 4:
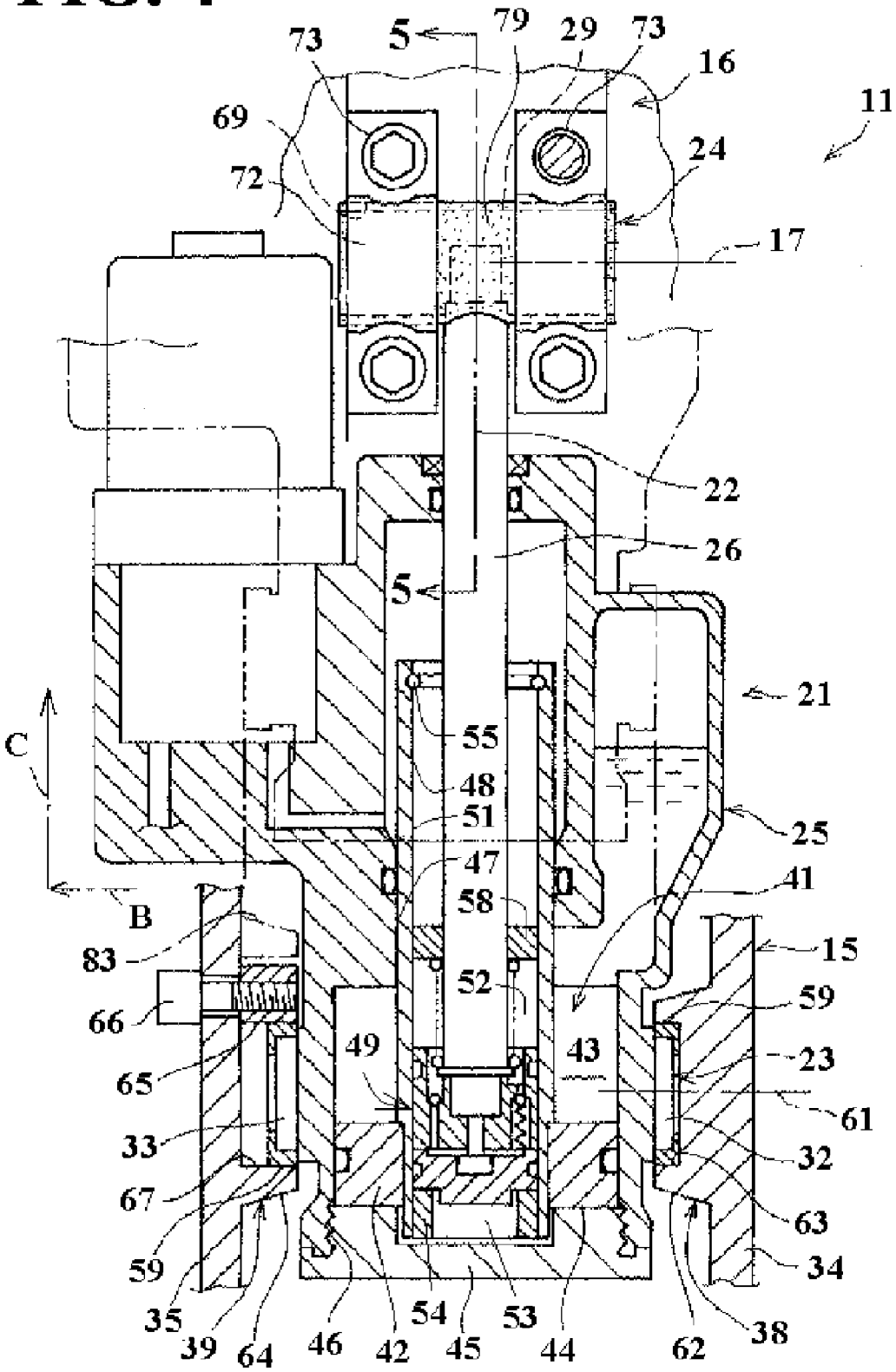
FIG. 4 is a partial cross sectional view of the tilt and trim unit taken through a transverse axis of the cylinder, showing the fully trimmed and tilted down position.

Since the holding member 65 is removable rather than integral, it may be desirable to provide a further reinforcing member 83, as shown in phantom in FIGS. 3 and 4, integrally with the bracket member 35 for backing up the semicircular holding member 65. Alternately the further reinforcing member 83 may be removably secured by means of other fasteners to the bracket member 35.

With the above described constructions, the lower pivot 23 comprises paired left and right projections 32 and 33 on the lower axis 61 projecting integrally from the outside surface of the cylinder body 25, and cooperating paired left and right bearing members 38 and 39 for pivoting receiving the projections 32 and 33 about the lower axis 61. Therefore, relative positions of the cylinder body 25 about the axis 22 of the tilt cylinder 21 and both the projections 32, 33 of the lower projection member 23 are maintained constant in contrast to the prior art constructions where the connection requires some adjustment to arrive at this relative position. Since such adjustment is unnecessary the attachment work is facilitated.

In addition, since both the projections 32 and 33 to project integrally from the cylinder body 25, the number of components of the outboard motor 11 is held reduced, so that its constitution become simple. Furthermore, both the projections 32 and 33 can be removed from both the bearing members 38 and 39 by moving the tilt cylinder 21 in the radial direction of the projections 32 and 33. Because of this the coupling and releasing both the projections 32 and 33 onto the respective bearing members 38 and 39 can be accomplished without deforming the shape of the clamp bracket 15. Therefore, the work of attaching the tilt cylinder 21 to the clamp bracket 15 can be done easily even though both the projections 32 and 33 are integral with the cylinder body 25.

Furthermore the upper pivot 24 is provided by a solid cylindrical element 55, placed on the upper part of the cylinder axis 22, with its axially middle portion secured to the extended end portion of the piston rod 33, and with its both end portions inserted into and pivoted with the paired left and right bearing recesses 74 formed in the upper portion of the propulsion unit 16 on the upper part of the cylinder axis 22. Therefore, it is possible to have a larger diameter it will have a sufficient strength.

Because a component of hollow cylindrical shape is replaced with the cylindrical element 29 of solid cylindrical shape, the cylindrical element 29 is made to have sufficient strength even without increasing its outside diameter dimension. Also since this constitution uses the solid cylindrical element 29 in place of the conventional boss part and pivot, the number of components is reduced and accordingly the upper pivot member 24 becomes simple in construction.

In addition the way the components are secured together, the work in pivotally connecting the upper end portion of the tilt cylinder 21 on the upper portion of the propulsion unit 16 is facilitated. In addition, since the extension plane of the mutually matching surfaces 76 of the upper portion of the propulsion unit 16 and the securing members 72 extend approximately parallel to the axis 22 of the tilt cylinder 21 and passes the vicinity of the upper axis 22 of the cylindrical element 55, in the state that the propeller 18 of the lower end portion of the propulsion unit 16 is below the water surface and the axis 22 of the tilt cylinder 21 extends in a generally vertical direction, when an external force is applied to the propulsion unit 16 through the cylindrical element 55 of the upper pivot member 24 from the tilt cylinder 21 with an intention of swinging the propulsion unit 16, the external force is divided and borne approximately evenly by the upper portion of the propulsion unit 16 and the securing members 72.

Of course those skilled in the art will readily understand that the described embodiments are only exemplary of forms that the invention may take and that various changes and modifications may be made without departing from the spirit and scope of the invention, as defined by the appended claims.

What is claimed is:

1. A pivoting arrangement for effecting pivotal movement of a marine propulsion device adapted to be pivotally supported about a pivot axis on an associated watercraft comprising a cylinder assembly defining a cylinder bore and adapted to be pivotally connected to one of the watercraft and the marine propulsion device, a piston supported for reciprocation within said cylinder bore, a piston rod affixed to said piston for operation thereby and extending externally of said cylinder assembly and adapted to be pivotally connected to the other of the watercraft and the marine propulsion device, at least one of said pivotal connections being formed by a pair of transversely extending cylindrical portions integrally formed by said cylinder assembly received in bearing portions carried by the associated watercraft.

2. A pivoting arrangement as set forth in claim 1 wherein the integral projections of the cylinder body are each received in beating openings formed in side plates of a clamping bracket adapted to be affixed to the watercraft.

3. A pivoting arrangement as set forth in claim 2 wherein the bearing openings each define complementary cylindrical surfaces of a diameter corresponding to that of the integral projections.

4. A pivoting arrangement as set forth in claim 3 wherein at least one of the bearing openings is integrally formed by the corresponding clamping side plate.

5. A pivoting arrangement as set forth in claim 4 wherein the other bearing openings is formed by a first portion integrally formed by the other corresponding clamping side plate and by a second portion detachably connected to the other corresponding clamping side plate.

* * * * *